US006068451A

United States Patent [19]

Uppal

[11] Patent Number: 6,068,451

[45] Date of Patent: May 30, 2000

[54] HYDRAULIC PUMP AND WIDE BAND NEUTRAL ARRANGEMENT THEREFOR

[75] Inventor: Sohal L. Uppal, Bloomington, Minn.

[73] Assignee: Eaton Corporation, Cleveland, Ohio

[21] Appl. No.: 09/238,322

[22] Filed: Jan. 28, 1999

[51] Int. Cl.[7] ..... F04B 1/26

[52] U.S. Cl. ..... 417/222.1; 417/269

[58] Field of Search ..... 417/222.1, 269, 417/222.2

[56] References Cited

U.S. PATENT DOCUMENTS

| | | | |
|---|---|---|---|
| Re. 23,993 | 5/1955 | Henrichsen | 103/162 |
| 3,282,225 | 11/1966 | Moon | 103/162 |
| 3,309,870 | 3/1967 | Pinkerton | 60/53 |
| 4,283,962 | 8/1981 | Forster | 74/42 |
| 4,584,926 | 4/1986 | Beck et al. | 92/12.2 |
| 5,207,144 | 5/1993 | Sporer et al. | 92/12.2 |
| 5,226,349 | 7/1993 | Alme et al. | 91/506 |
| 5,624,240 | 4/1997 | Kawaguchi et al. | 417/222.2 |

*Primary Examiner*—Timothy S. Thorpe
*Assistant Examiner*—Trelita Perry
*Attorney, Agent, or Firm*—L. J. Kasper

[57] ABSTRACT

A variable displacement axial piston pump (11) including a housing (19 and a back plate (25), with a cylinder barrel (29) rotating therein, and defining a plurality of cylinders (31), and a piston (33) reciprocably disposed in each one. There is a tiltable swashplate (37) whereby the displacement of the pump can be varied. In one embodiment, an open center shuttle assembly (71) is disposed in the swashplate (37), and interconnects the high and low pressure paths of the pump to provide a wide neutral band. When the pump is displaced intentionally, the resulting pressure in the high pressure path biases the shuttle to a closed position, permitting normal operation of the pump. In a second embodiment, the shuttle assembly (71) is disposed in the back plate (25), and is accompanied by a load holding valve assembly (105), which insures that, when the vehicle is on an incline, the fluid pumped by the propel motors won't flow through the shuttle assembly (71).

9 Claims, 4 Drawing Sheets

HYDRAULIC PUMP AND WIDE BAND NEUTRAL ARRANGEMENT THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to variable displacement hydraulic pumps having a rotating group and a tiltable swashplate for varying the displacement of the rotating group, and more particularly, to a "wide band neutral" arrangement for such pumps, i.e., a device which substantially eliminates flow from the pump, when the swashplate is close to neutral, even if the pump is not at absolute zero displacement.

Although the hydraulic pump for use with the present invention may include various types of rotating groups, it is especially advantageous when used with a rotating group of the "axial piston" type, i.e., one which includes a rotating cylinder barrel defining a plurality of cylinders, and a piston reciprocable within each cylinder. Therefore, the present invention will be described in connection with such an axial piston pump.

Among the types of axial piston pumps known to those skilled in the art is one in which the tiltable swashplate includes a pair of transversely opposed trunnions which are rotatably supported, relative to the pump housing, by suitable bearing means. A pump of the type described is sometimes referred to as a "trunnion pump"

Although the present invention may be used in axial piston pumps of the trunnion type, as illustrated and described in U.S. Pat. No. 5,358,388, assigned to the assignee of the present invention, and incorporated herein by reference, the invention is even better suited for use in pumps of the "swash and cradle" type, and will be described in connection therewith. Swash and cradle axial piston pumps may be better understood by referring to U.S. Pat. No. 5,590,579, also assigned to the assignee of the present invention, and incorporated herein by reference.

Changes in displacement of an axial piston pump (by changing the tilt angle of the swashplate) may be accomplished either by an appropriate servo mechanism or by a manual input. In either case, it is important for the pump to be able to achieve true neutral, such that there is no substantial flow of pressurized fluid out of the pump when the vehicle operator selects neutral operation of the pump. As is well known to those skilled in the art, the inability of a variable displacement axial piston pump to achieve neutral is extremely undesirable, especially in a vehicle propel system, because even a small flow of pressurized fluid may result in vehicle "creep", i.e., unintended movement of the vehicle, which at the very least, can be annoying to the operator, and may in some situations also be potentially dangerous.

Typically, if displacement changes are accomplished by a servo mechanism, the servo mechanism itself may include an appropriate centering device, i.e., a device which biases the pump displacement toward zero, in the absence of some sort of input displacement command. The wide band neutral arrangement of the present invention may be used advantageously with a servo controlled pump because, typically, there are limitations in accuracy of the return-to-neutral mechanism within the servo mechanism.

However, in the case of a pump which has its displacement varied manually, it is generally recognized as being essential to provide some sort of neutral centering mechanism which will insure effective neutral of the swashplate (and absolute zero flow from the pump) whenever the manual input member is at or very near its neutral position.

Various neutral centering devices have been designed by those skilled in the art. Unfortunately, many of the prior art neutral centering devices have been either complicated and expensive, or difficult to assemble, or have provided insufficient biasing force toward neutral, whenever operating near, but not at precisely neutral. For example, the neutral centering devices of the type illustrated and described in U.S. Pat. Nos. 4,584,926 and 5,207,144 would both appear likely to achieve neutral in a satisfactory manner. However, the ability of the designs of the cited patents to achieve neutral is very tolerance-dependent, and requires the addition of a number of parts which must be located within the pumping chamber, surrounding the rotating group, which may be a packaging problem in some pump designs.

BRIEF SUMMARY OF THE INVENTION

Accordingly, it is an object of the present invention to provide an improved wide band neutral arrangement, which overcomes the disadvantages of the prior art devices.

It is a more specific object of the present invention to provide an improved wide band neutral arrangement of the type which does not require the addition of any sort of mechanism within the pumping chamber, surrounding the rotating group, which would represent substantial added cost and complexity.

It is a further object of the present invention to provide an improved wide band neutral arrangement which accomplishes the above-stated objects without the need for extremely close tolerances, in order to achieve effective neutral.

It is another object of the present invention to provide an improved wide band neutral arrangement which would discontinue the neutral leakage when the pump is not running, to improve load holding capability when the vehicle is on an incline.

It is still another object of the present invention to provide an improved wide band neutral arrangement which will provide for a smooth transition between the neutral (zero flow) condition and the operating (normal flow) condition.

The above and other objects of the invention are accomplished by the provision of a variable displacement hydrostatic pump of the type comprising housing means defining a source of case pressure. A cylinder barrel is rotatably mounted within the housing means and defines a plurality of cylinders, and a piston is disposed within each cylinder. A cam means is disposed within the housing means and is pivotable relative thereto, and includes a swashplate operably associated with each of the pistons to cause reciprocal movement thereof in response to rotation of the cylinder barrel when the cam means is displaced from a neutral position. The housing means and the pistons cooperate to define a first pressure fluid path, and a second pressure fluid path when the cam means is displaced from the neutral position.

The improved pump is characterized by one of the housing means and the swashplate defining a shuttle bore interconnecting the first pressure fluid path and the second pressure fluid path. An open-center shuttle assembly is operably disposed in the shuttle bore to define a first pressure chamber in fluid communication with the first pressure fluid path, and a second pressure chamber in fluid communication with the second pressure fluid path. The shuttle bore defines first and second shuttle seats, and the shuttle bore, intermediate the shuttle seats, is in fluid communication with the source of case pressure. A means biases the open-center shuttle assembly toward a centered position, in the absence of fluid pressure, in excess of a predetermined fluid pressure, in one of the first and second pressure chambers. As a result, below the predetermined fluid pressure in one of the first and second pressure chambers, both of the first and second pressure fluid paths are in relatively unrestricted fluid communication with the source of case pressure.

DETAILED DESCRIPTION OF THE PREFERRED EMBODIMENT

Figure 1:
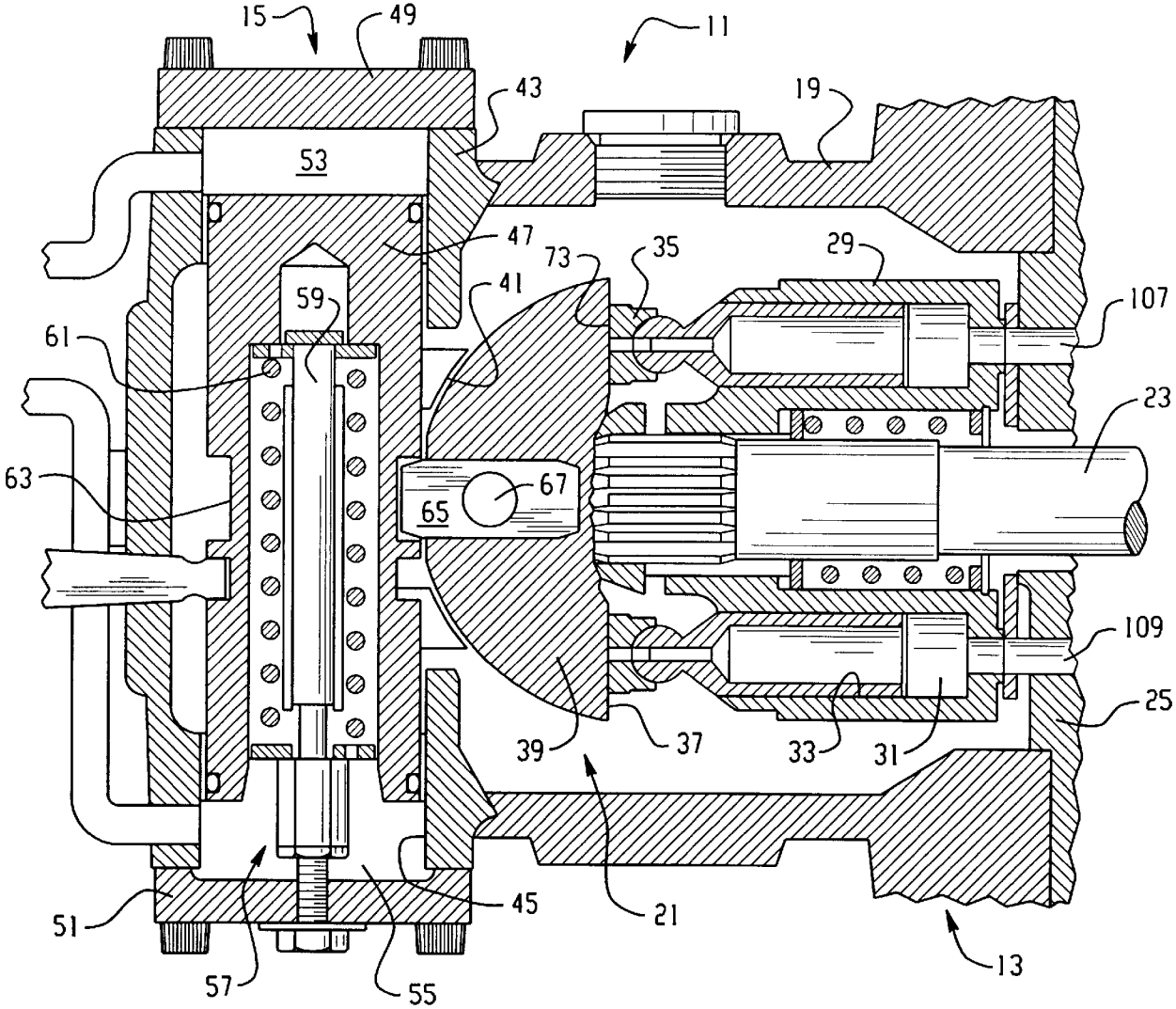
FIG. 1 is a somewhat schematic, fragmentary, axial cross-section of a variable displacement axial piston pump of the type to which the present invention may be applied.

Referring now to the drawings, which are not intended to limit the invention, FIG. 1 illustrates a variable displacement axial piston pump, generally designated 11, of a type with which the present invention may be utilized. The pump 11 comprises two main portions: a pumping element 13 and a fluid pressure actuated servo-assembly 15.

The pumping element 13 includes a pump housing 19 which defines an internal cavity 21. An input shaft 23 extends into the internal cavity 21, and then extends to the right through an opening in a port housing 25 to drive a charge pump (not shown herein). The port housing 25 is also sometimes referred to as a back plate or as an end cap. As is used sometimes hereinafter, and in the appended claims, the term "housing means" may mean and include both the pump housing 19 and the back plate 25, in view of the fact that the housing 19 and back plate 25 cooperate to define the internal cavity 21.

Disposed about the input shaft 23, within the internal cavity 21, is a cylinder barrel 29 which is splined to the input shaft 23 to rotate therewith. The rotatable barrel 29 defines a plurality of cylinder bores 31, and disposed for reciprocating movement within each bore 31 is a piston 33. Each piston 33 includes a generally spherical head which is received within a piston shoe 35 (also sometimes referred to as a "slipper"). The piston shoes 35 are retained in contact with a swashplate 37 in a manner generally well known to those skilled in the art. The swashplate 37 is carried by a cam member 39, which is typically mounted in a cam support 41. The swashplate 37 may merely comprise the surface of the cam member 39, as in the subject embodiment, or comprise a separate member. Therefore, "37" will be used hereinafter to refer either to the swashplate surface or to the cam surface.

In FIG. 1, the cam member 39 is shown in its neutral position, and movement of the cam member from the neutral position in either direction will result in the stroke of the pistons 33 being changed in such a way that rotation of the barrel 29 will result in an output flow of pressurized fluid from the pumping element 13. During operation of the pump, with the swashplate tilted somewhat, the housing 19, the cylinders 31 and the pistons 33 cooperate to define a pair of "pressure fluid paths", one on the suction (inlet) side of the pump, and the other on the discharge (outlet) side of the pump. These paths, which are well understood by those skilled in the art, and which are not labeled in the drawings, will sometimes be referred to as "A" and "B" hereinafter.

The fluid pressure actuated servo-assembly 15 comprises, in the subject embodiment, a separate servo-housing 43 suitably attached to the pump housing 19. The servo-housing 43 defines a servo-cylinder 45, and axially displaceable therein is a servo-piston 47, which is shown in its neutral position in FIG. 1, corresponding to the neutral position of the cam member 39. Bolted to the servo-housing 43 is an upper end cap 49, and a lower end cap 51, the end caps 49 and 51 cooperating with the housing 43 and the piston 47 to define upper and lower servo-chambers 53 and 55, respectively. The servo-piston 47 is provided with a neutral centering spring assembly 57, the function of which is to return the servo-piston 47 to its neutral position shown in FIG. 1, in the absence of control fluid pressure in either of the chambers 53 or 55. The neutral centering spring assembly 57 primarily comprises a spring support member 59, and a coil compression spring 61.

The servo-piston 47 defines an annular groove 63 which receives the forward end of a servo piston follower 65. The follower 65 is attached to the cam member 39 by means of a follower pin 67, which is offset from the axis of pivotal movement of the cam member 39. As a result, movement of the servo-piston 47 in a downward direction in FIG. 1 will move the servo-piston follower 65 downward, causing the cam member 39 to pivot in a counterclockwise direction from the neutral position of FIG. 1.

The communication of control fluid pressure to the servo-chambers 53 and 55 may be accomplished in any one of several different ways, one of which is to use what is referred to as a "standard manual controller". Such an arrangement is illustrated and described in U.S. Pat. No. 5,226,349, assigned to the assignee of the present invention and incorporated herein by reference.

Figure 2:
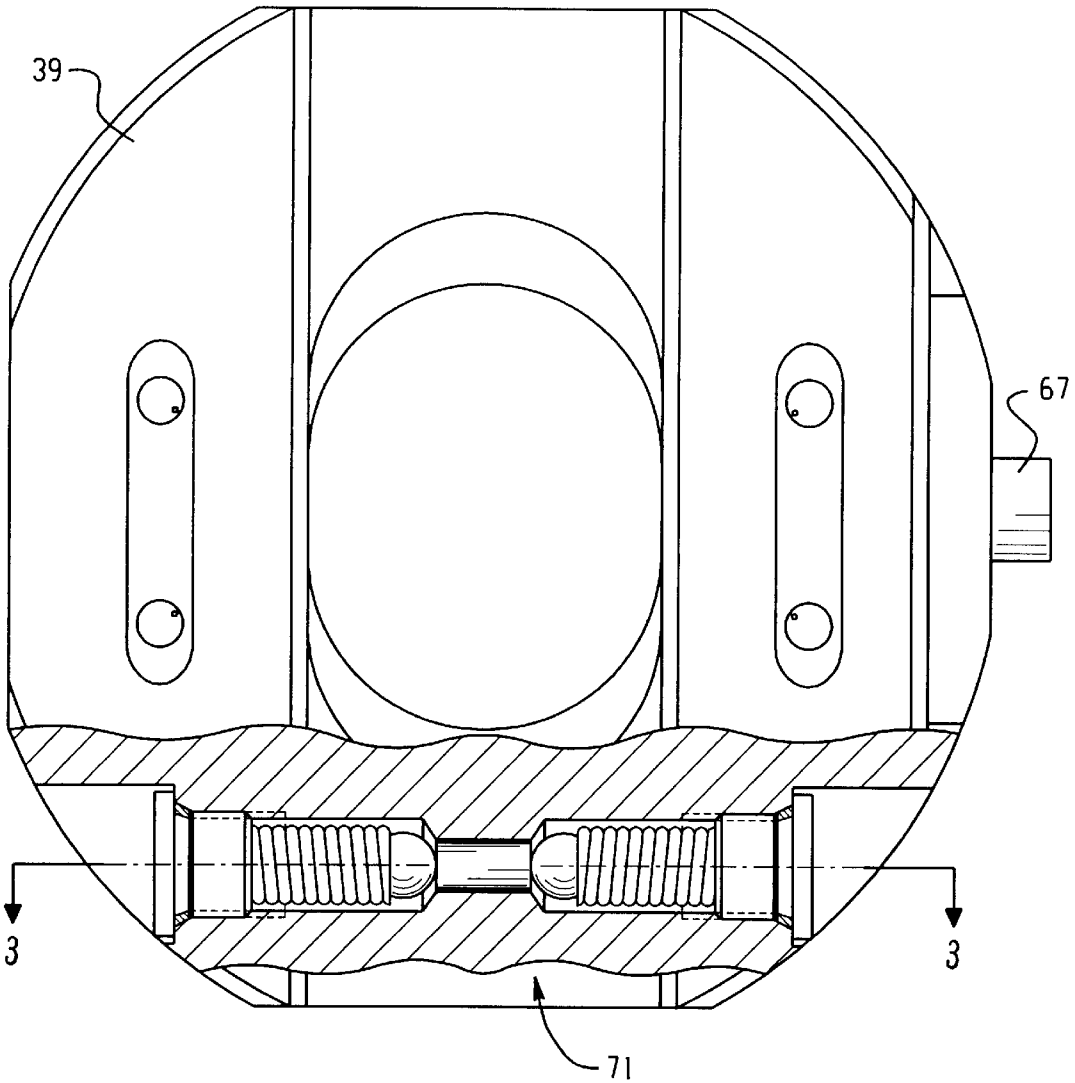
FIG. 2 is an enlarged view, partly in transverse cross-section, and partly in front plan view, of the swashplate of the pump of FIG. 1, illustrating the subject embodiment of the invention.

Referring now primarily to FIG. 2, there is illustrated a preferred embodiment of the present invention, wherein there is provided a wide-band neutral arrangement, generally designated 71, with the arrangement 71 being disposed within the cam member 39 (which is the same as being disposed within the swashplate 37, if the swashplate 37 and cam member 39 comprise two separate members).

As is understood by those skilled in the art, whenever the cam member 39 is even slightly displaced from its neutral position of FIG. 1, the pistons 33 reciprocate slightly within the cylinder bores 31, thus generating a small amount of pressurized flow within those cylinders ("contracting") in which the pistons are being "extended", i.e., moved to the right in FIG. 1. A typical pressure in the contracting cylinders, when the cam member 39 is slightly displaced from neutral, would be about 200 psi. At the same time, there is a relatively low pressure, typically about 100 psi, in those cylinders ("expanding") in which the pistons are "retracting" i.e., moving to the left in FIG. 1.

Conventionally, the pistons 33 are either hollow, as shown in FIG. 1, or at least define some sort of passage therethrough, partly so that lubrication fluid may be communicated to the interface between the spherical head of the piston 33 and the adjacent, mating surface of the slipper 35. Typically, the slipper 35 also defines a fluid passage, so that whatever fluid pressure is in the cylinder is communicated to a cam-engaging surface 73 (see FIG. 1) of the slipper 35. As a result, there is a build up of pressure and a hydrodynamic bearing formed between the surface 73 of the slipper 35 and the adjacent swashplate surface 37, lubricating the slippers 35, as each slipper moves about the swashplate surface 37 in a generally circular path (see FIG. 4), in response to rotation of the cylinder barrel 29.

Figure 3:
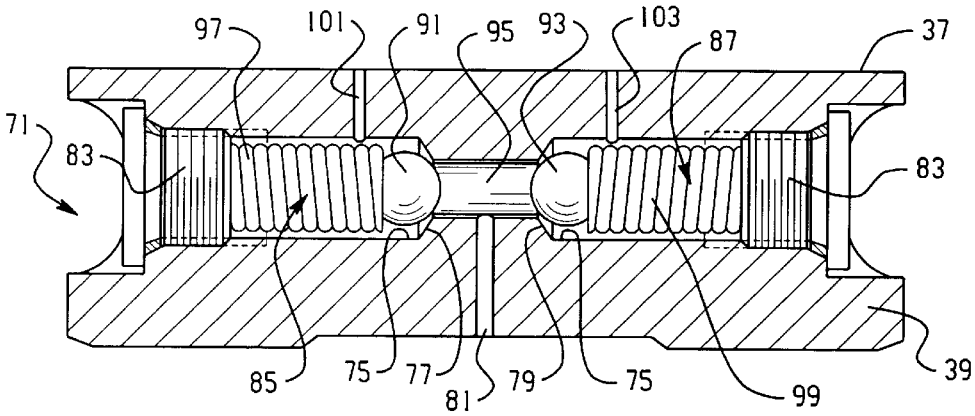
FIG. 3 is an axial cross-section taken on line 3—3 of FIG. 2, and illustrating one aspect of the invention.

Referring now primarily to FIG. 3, the wide band neutral arrangement 71 comprises an open-center shuttle valve assembly, also bearing the reference numeral "71". The assembly 71 includes a shuttle bore 75, which actually comprises two separate bores 75, each of which includes a tapered or conical portion, forming shuttle seats 77 and 79. In the subject embodiment, and by way of example only, the seats 77 and 79 are interconnected by a smaller bore portion which is in open communication with a passage 81 which provides fluid communication to the internal cavity 21 (also referred to as "case drain" or as a "source of case pressure"), it being understood that "case pressure" is typically very low, e.g., in the range of zero to 20 psi. However, within the scope of the present invention, instead of communicating the passage 81 to case drain, it would be generally acceptable to merely have one side of the shuttle assembly communicate to the other side, i.e., have the pressure fluid path A communicate to the pressure fluid path B. Such an arrangement will be illustrated and described in connection with the embodiment of FIG. 5.

The outer ends of the shuttle bores 75 are internally threaded, and each has a threaded plug 83 in engagement therewith. The left bore 75, the plug 83, and the shuttle seat 77 cooperate to define a pressure chamber 85, while the right bore 75, the plug 83, and the shuttle seat 79 cooperate to define a pressure chamber 87.

The shuttle valve assembly 71 includes a pair of shuttle balls 91 and 93, spaced apart by a generally cylindrical spacer plug 95. The shuttle ball 91 is biased into engagement with the left end of the plug 95 by means of a compression spring 97, while the shuttle ball 93 is biased into engagement with the right end of the plug 95 by a compression spring 99.

It is one important aspect of the present invention that the shuttle valve assembly 71 comprise an "open-center" shuttle valve assembly. As used herein, the term "opencenter" means that, in the absence of a certain predetermined pressure differential between the chambers 85 and 87, the shuttle valve assembly 71 remains in the position shown in FIGS. 2 and 3, with each of the shuttle balls 91 and 93 held out of engagement with its respective seat 77 and 79. In this open-center position, a slight pressure differential between the chambers 85 and 87 will simply result in flow from whichever chamber 85 or 87 is at higher pressure, past its respective shuttle ball, 91 or 93, through the passage 81, and to the case drain, thus re-establishing the equality of the pressures in the chambers 85 and 87.

Figure 4:
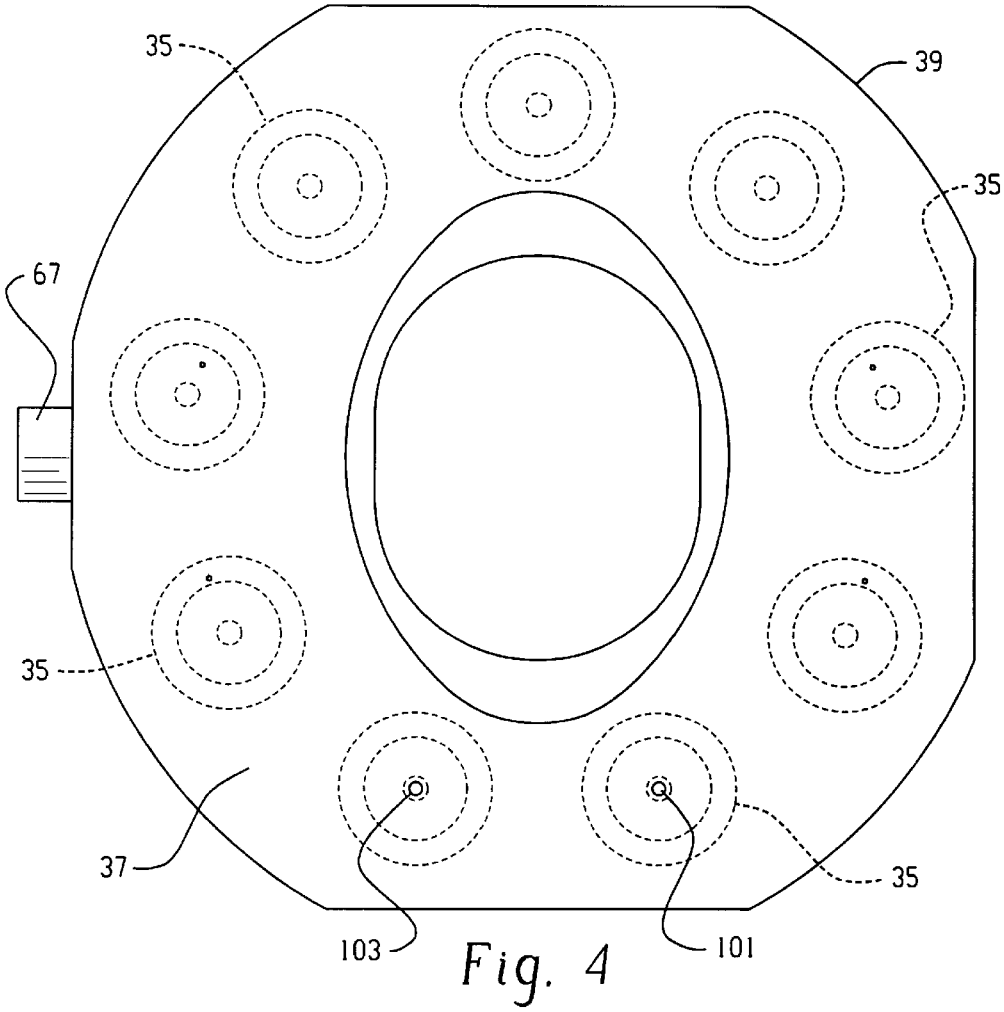
FIG. 4 is a rear plan view of the swashplate shown in FIG. 2, on a somewhat smaller scale than FIG. 2, and illustrating another aspect of the invention.

In accordance with another important aspect of the present invention, the pressure chamber 85 is in communication, by means of a fluid passage 101, with the swashplate surface 37. Similarly, the pressure chamber 87 is in communication, by means of a fluid passage 103, with the swashplate surface 37. Referring now also to FIG. 4, it is preferred that the passages 101 and 103 be located, circumferentially relative to each other, as shown in FIG. 4, i.e., at the same spacing as the pistons 33 and slippers 35. It should be remembered that, typically, and by way of example only, all of the cylinders 31 on the right side of FIG. 4 would be in fluid communication with each other (pressure fluid path A), while all of the cylinders 31 on the left side of FIG. 4 would be in fluid communication with each other (pressure fluid path B). This common fluid communication would be by way of inlet and outlet kidney porting 107 and 109, respectively, which is conventionally in the housing 19, or more specifically, is in the back plate 25 in FIG. 1.

As a result, with the slippers 35 in the position shown in FIG. 4, if the swashplate 39 is displaced slightly, there will be "high" pressure (part of pressure path A) in passage 101, for example, and "low" pressure (part of pressure path B) in passage 103. As long as the high pressure in pressure path A is less than a predetermined pressure, such as 200 psi., such a pressure will merely indicate that the swashplate has been commanded to neutral, but hasn't quite achieved neutral. In this condition, the high pressure (but below 200 psi.) in the passage 101 and pressure chamber 85 will not be enough to bias the shuttle ball 91 into engagement with the seat 77, and the resulting flow through the passage 81 to case drain will "relieve" the high pressure sufficiently so that the pump output is effectively zero ("effective neutral") and is insufficient to propel the vehicle (and cause "creep"), etc.

When the vehicle operator wishes to operate the pump, and command a particular pump displacement, the resulting pressure in the pressure fluid path A (assumed to be the high pressure, discharge side) will be in excess of the predetermined 200 psi., and such pressure in the chamber 85 will overcome the biasing force of the opposite spring 99, and bias the shuttle ball 91 into engagement with its seat 77. Fluid will no longer be able to flow from the pressure chamber 85 to the passage 81, but instead, the pressure fluid path A will now be isolated from the pressure fluid path B, and the pump can operate in the normal manner.

Typically, even the "low pressure" side of the system (pressure fluid path B) is at about 100 psi., well in excess of the case pressure. Thus, it is preferred that the passages 101 and 103 be spaced as shown in FIG. 4. Therefore, at a particular instant in time, the passage 101 communicates high pressure to the chamber 85 while the passage 103 communicates low pressure to the chamber 87. If the passages 101 and 103 were not on the centers of the slippers as shown in FIG. 4, the chambers 85 and 87 would see high and low pressure at different times, causing the shuttle assembly to oscillate and alternately engage the seats 77 and 79.

Figure 5:
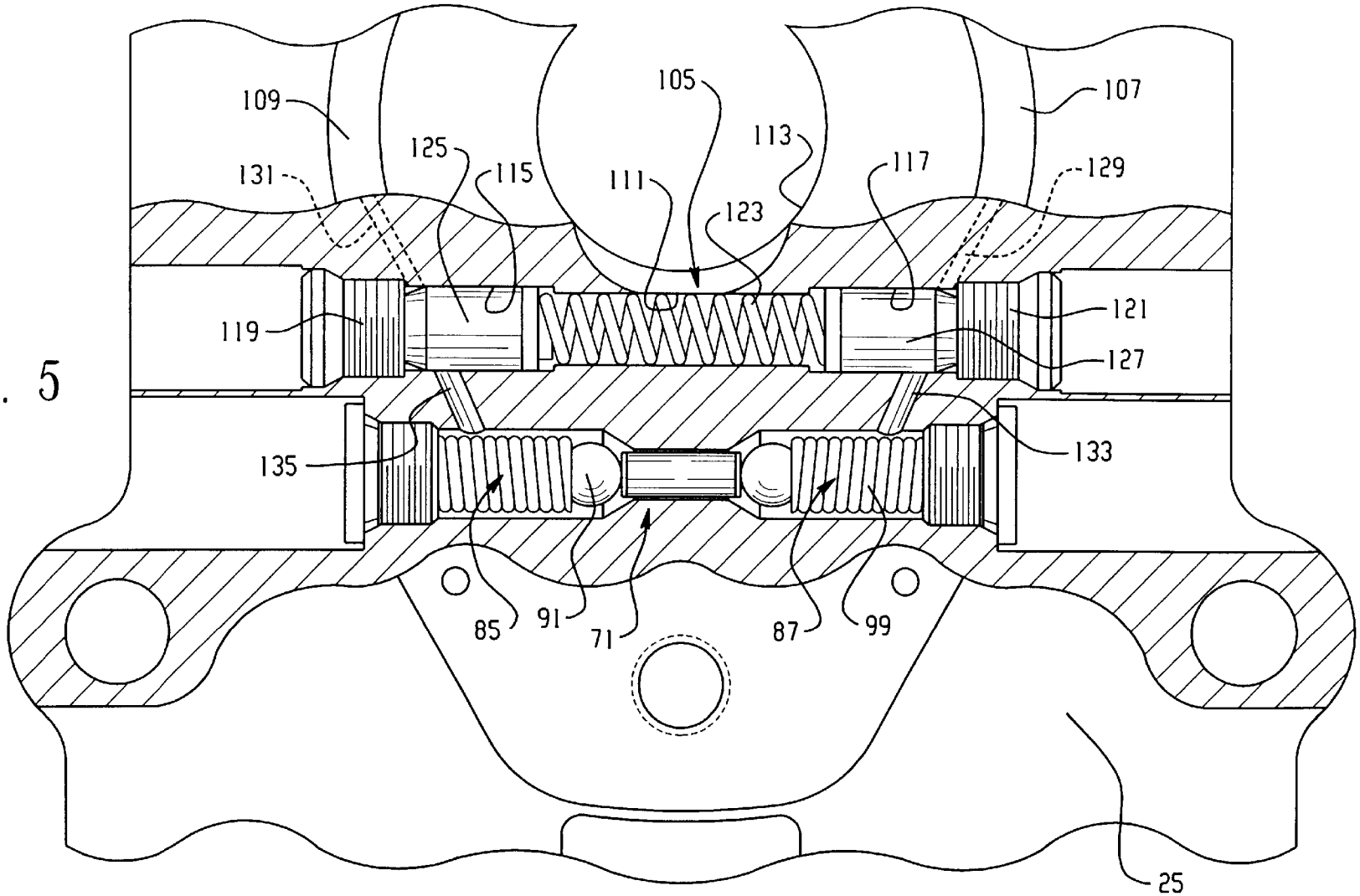
FIG. 5 is a transverse cross-section through the back plate of a pump of the type shown in FIG. 1, illustrating an alternative embodiment of the present invention.

Referring now primarily to FIG. 5, there is illustrated an alternative embodiment of the invention in which the wide band neutral arrangement 71 is disposed in the back plate 25, rather than in the swashplate 37 (or cam member 39). Also, the embodiment of FIG. 5 deals with a problem which occurs on some vehicles which do not have individual wheel brakes, but instead, rely on "hydrostatic braking" of the vehicle, as that term is understood by those skilled in the vehicle art. On such a vehicle, using only the wide band neutral arrangement 71 of FIGS. 2 through 4, when the vehicle engine is shut off, the arrangement 71 represents a source of "cross port" leakage, i.e., it permits some fluid communication between the pressure fluid paths A and B. As a result, if the vehicle is on an incline, the wheel motors can act as a pump, and pump fluid through the propel pump 11, and from path A to path B, through the arrangement 71 without any rotation of the cylinder barrel 29 and input shaft 23, thus with no hydrostatic braking occurring.

Therefore, in the embodiment of FIG. 5, there is, in addition to the wide band neutral arrangement 71, a "second stage" shuttle assembly, generally designated 105, which may also be referred to as a "load holding" valve assembly. Also shown in FIG. 5, and on a different plane than the valve assembly 105, are the inlet kidney 107 and the outlet kidney 109 (see also FIG. 1). The load holding valve assembly 105 comprises a central bore 111 which is in open communication with the internal cavity 21 by means of a bore 113 which surrounds the output shaft 23. The valve assembly 105 also includes an enlarged bore portion 115 and an enlarged bore portion 117, with the bore portions 115 and 117 being sealed at their axially outer ends by threaded plugs 119 and 121, respectively.

Disposed within the central bore 111 is a compression spring 123, and disposed within the enlarged bore portions 115 and 117, and in fairly close fitting relationship therein, are pistons 125 and 127, respectively. The inlet kidney 107 is in communication with the bore portion 117 by means of a fluid passage 129, and similarly, the outlet kidney 109 is in fluid communication with the bore portion 115 by means of a fluid passage 131. In turn, the bore portion 117 is in fluid communication with the pressure chamber 87 of the wide band neutral arrangement 71 by means of a fluid passage 133 and similarly, the bore portion 115 is in fluid communication with the pressure chamber 85 of the arrangement 71 by means of a fluid passage 135. It is important to note that, in the absence of any substantial fluid pressure in either of the kidneys 107 or 109, the spring 123 biases the pistons 125 and 127 axially outward, to the positions shown in FIG. 5, in engagement with the threaded plugs 119 and 121, respectively. With the pistons 125 and 127 in the positions shown in FIG. 5, fluid communication from the bore portions 115 and 117 to the fluid passages 135 and 133, respectively, is blocked. Therefore, with the vehicle engine not running, the wide band neutral arrangement 71, which as noted previously is "open-center", does not act as a leak path for fluid being pumped by the wheel motors, but instead, flow through the wide band neutral arrangement 71 is blocked by the load holding valve assembly 105.

When the vehicle operator shifts the pump 11 from its neutral position shown in FIG. 1 by moving the cam member 39 and swashplate 37 to a displaced position, pressurized fluid in the outlet kidney 109 will flow through the fluid passage 137 and act on the left end of the piston 125, biasing it to the right in FIG. 5 in opposition to the force of the spring 123. This rightward movement of the piston 125 will open up a communication path from the fluid passage 131, through the enlarged bore portion 115 and then through the fluid passage 135 into the pressure chamber 85. If the fluid in the outlet kidney 109 is still below the predetermined pressure, such as the 200 psi mentioned previously, the wide band neutral arrangement 71 will remain in its open center condition, and the fluid will flow through the shuttle assembly into the pressure chamber 87 (rather than to case drain as was described in connection with FIG. 3). In accordance with an important aspect of the FIG. 5 embodiment, the spring 123 is selected such that the pressure communicated to the pressure chamber 87 is sufficient to flow through the fluid passage 133 and act on the right end of the piston 127, biasing it to the left in FIG. 5 in opposition to the force of the spring 123, moving the piston 127 far enough to the left to open up a substantial flow path from the fluid passage 133 through the bore portion 117 then through the fluid passage 129 to the inlet kidney 107. Those skilled in the art will understand that the spring 123 should be selected such that the fluid pressure which would typically be generated by the propel motors as the vehicle would be on an incline would be insufficient to overcome the spring 123.

When the vehicle operator displaces the swashplate 37 further from the neutral position shown in FIG. 1, thus generating pressure substantially greater than, for example, 200 psi in the outlet kidney 109, that pressure again causes the piston 125 to shift to the right in FIG. 5, such that the pressure enters the pressure chamber 85, and biases the shuttle ball 91 to the right in opposition to the biasing force of the spring 99, as was described previously. When the shuttle ball 91 is seated, fluid communication from the outlet kidney 109 back to the inlet kidney 107 is blocked, and the pump is thereafter able to operate in the normal manner.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A variable displacement hydrostatic pump of the type comprising housing means defining a source of case pressure; a cylinder barrel rotatably mounted within said housing means and defining a plurality of cylinders, a piston disposed within each cylinder; cam means disposed within said housing means and being pivotable relative thereto, including a swashplate operably associated with each of said pistons to cause reciprocal movement thereof in response to rotation of said cylinder barrel when said cam means is displaced from a neutral position; said housing means and said pistons cooperating to define a first pressure fluid path, and a second pressure fluid path when said cam means is displaced from said neutral position; characterized by:

(a) one of said housing means and said swashplate defining a shuttle bore interconnecting said first pressure fluid path and said second pressure fluid path;

(b) an open-center shuttle assembly operably disposed in said shuttle bore to define a first pressure chamber in fluid communication with said first pressure fluid path and a second pressure chamber in fluid communication with said second pressure fluid path;

(c) said shuttle bore defining first and second shuttle seats, and said shuttle bore, intermediate said shuttle seats, being in fluid communication with said source of case pressure;

(d) means biasing said open-center shuttle assembly toward a centered position, in the absence of fluid pressure, in excess of a predetermined fluid pressure, in one of said first and second pressure chambers whereby, below said predetermined fluid pressure in one of said first and second pressure chambers, both of said first and second pressure fluid paths are in relatively unrestricted fluid communication with said source of case pressure.

2. A variable displacement hydrostatic pump as claimed in claim 1, characterized by said predetermined fluid pressure being selected such that, when said cam means is intentionally displaced from said neutral position, in a first direction, the fluid pressure in said first pressure chamber is sufficient to overcome said biasing means and bias said open-center shuttle assemble in a first direction, to engage said first shuttle seat, and block fluid communication from said first pressure fluid path and said first pressure chamber to said source of case pressure.

3. A variable displacement hydrostatic pump as claimed in claim 1, characterized by a fluid pressure actuated servo-assembly operable to displace said cam means from said neutral position in response to the presence of a control fluid pressure.

4. A variable displacement hydrostatic pump as claimed in claim 1, characterized by said swashplate defining said shuttle bore, and further defining a cam surface adapted for engagement with each of said pistons about a generally circular region of said cam surface in response to rotation of said cylinder barrel.

5. A variable displacement hydrostatic pump as claimed in claim 3, characterized by each of said pistons including a slipper member including a cam-engaging surface and being operable to communicate fluid pressure from one of said first and second pressure fluid paths to said cam-engaging surface.

6. A variable displacement hydrostatic pump as claimed in claim 4, characterized by said swashplate defining first and second fluid passages providing fluid communication between said circular region of said cam surface, and said first and second pressure chambers, respectively.

7. A variable displacement hydrostatic pump of the type comprising housing means; a cylinder barrel rotatably mounted within said housing means and defining a plurality of cylinders, a piston disposed within each cylinder; cam means disposed within said housing means and being pivotable relative thereto, including a swashplate operably associated with each of said pistons to cause reciprocal movement thereof in response to rotation of said cylinder barrel when said cam means is displaced from a neutral position; said housing means and said pistons cooperating to define a high pressure fluid path, and a low pressure fluid path when said cam means is displaced from said neutral position; characterized by:

(a) one of said housing means and said swashplate defining a shuttle bore interconnecting said high pressure fluid path and said low pressure fluid path;

(b) an open-center shuttle assembly operably disposed in said shuttle bore to define a first pressure chamber in fluid communication with said high pressure fluid path and a second pressure chamber in fluid communication with said low pressure fluid path;

(c) said shuttle bore defining first and second shuttle seats;

(d) means biasing said open-center shuttle assembly toward a centered position, in the absence of fluid pressure, in excess of a predetermined fluid pressure, in one of said first and second pressure chambers whereby, below said predetermined fluid pressure in one of said first and second pressure chambers, said high pressure fluid path is in relatively unrestricted fluid communication with said low pressure fluid path.

8. A variable displacement hydrostatic pump as claimed in claim 7, characterized by said predetermined fluid pressure being selected such that, when said cam means is intentionally displaced from said neutral position, in a first direction, the fluid pressure in said first pressure chamber is sufficient to overcome said biasing means and bias said open-center shuttle assemble in a first direction, to engage said first shuttle seat, and block fluid communication from said first pressure fluid path and said first pressure chamber to said second pressure fluid path and said second pressure chamber.

9. A variable displacement hydrostatic pump as claimed in claim 7, characterized by said housing means defining said shuttle bore.

* * * * *